US011021925B2

(12) United States Patent
Atkins et al.

(10) Patent No.: US 11,021,925 B2
(45) Date of Patent: Jun. 1, 2021

(54) PRESSURE CONTROL DEVICE

(71) Applicant: Rubberatkins Limited, Aberdeenshire (GB)

(72) Inventors: Nicholas Atkins, Aberdeenshire (GB); Craig Spalding, Aberdeenshire (GB); Krishna Kankanalapalli, Aberdeenshire (GB); Vijay Amirtharaj Avanashiappan, Aberdeenshire (GB)

(73) Assignee: RUBBERATKINS LIMITED, Aberdeen (GB)

( * ) Notice: Subject to any disclaimer, the term of this patent is extended or adjusted under 35 U.S.C. 154(b) by 59 days.

(21) Appl. No.: 16/062,848

(22) PCT Filed: Dec. 15, 2016

(86) PCT No.: PCT/GB2016/053947

§ 371 (c)(1),
(2) Date: Jun. 15, 2018

(87) PCT Pub. No.: WO2017/103595

PCT Pub. Date: Jun. 22, 2017

(65) Prior Publication Data

US 2019/0003276 A1 Jan. 3, 2019

(30) Foreign Application Priority Data

Dec. 15, 2015 (GB) ..... 1522135

(51) Int. Cl.
*E21B 33/12* (2006.01)
*E21B 33/126* (2006.01)

(52) U.S. Cl.
CPC ..... *E21B 33/12* (2013.01); *E21B 33/126* (2013.01)

(58) Field of Classification Search
CPC ..... E21B 33/126; E21B 17/085; E21B 33/12; E21B 33/1208; E21B 33/1293; E21B 33/1294; E21B 34/101; E21B 43/123; F16L 27/103; F16L 39/04
See application file for complete search history.

(56) References Cited

U.S. PATENT DOCUMENTS 56,234 A * 7/1866 Latham ..... E21B 33/122 166/189
4,103,939 A 8/1978 Herbert
(Continued)

FOREIGN PATENT DOCUMENTS

GB 2509336 A 7/2014
WO 9850673 A1 11/1998

OTHER PUBLICATIONS

International Search Report dated May 16, 2017 for corresponding International Patent Application No. PCT/GB2016/053947.

*Primary Examiner* — Daniel P Stephenson
(74) *Attorney, Agent, or Firm* — Tarolli, Sundheim, Covell & Tummino LLP

(57) ABSTRACT

A pressure control device for use in an oil well is described. The pressure control device comprises a support member configured to be located on a mandrel or a tubular, the support member defining at least one conduit throughbore configured to receive a conduit and a flexible cup member mounted to the support member. In use, a conduit can pass through the pressure control device intact.

21 Claims, 9 Drawing Sheets

(56) References Cited

U.S. PATENT DOCUMENTS

| | | | | |
|---|---|---|---|---|
| 6,173,788 | B1 * | 1/2001 | Lembcke | E21B 33/128 166/387 |
| 6,367,845 | B1 * | 4/2002 | Otten | F16L 7/00 285/119 |
| 6,808,024 | B2 * | 10/2004 | Schwendemann | E21B 17/003 166/180 |
| 7,264,061 | B2 * | 9/2007 | Dybevik | E21B 33/1208 166/385 |
| 7,762,322 | B2 * | 7/2010 | Andersen | E21B 17/023 166/118 |
| 8,083,000 | B2 * | 12/2011 | Nutley | E21B 17/003 166/387 |
| 9,303,478 | B2 * | 4/2016 | Scruggs | E21B 47/12 |
| 9,416,596 | B2 * | 8/2016 | Maier | E21B 33/126 |
| 9,903,175 | B2 * | 2/2018 | Atkins | E21B 33/126 |
| 10,174,582 | B2 * | 1/2019 | Windegaard | E21B 43/123 |
| 10,329,866 | B2 * | 6/2019 | Frazee | E21B 17/023 |
| 10,364,641 | B2 * | 7/2019 | Carmody | E21B 23/06 |
| 10,513,921 | B2 * | 12/2019 | Goodman | E21B 33/1208 |
| 2004/0065437 | A1 * | 4/2004 | Bostick, III | E21B 47/011 166/250.01 |
| 2015/0354315 | A1 | 12/2015 | Windegaard | |
| 2019/0003276 | A1 * | 1/2019 | Atkins | E21B 33/12 |

* cited by examiner

PRESSURE CONTROL DEVICE

RELATED APPLICATIONS

The present application is a U.S. National Stage application under 35 USC 371 of PCT Application Serial No. PCT/GB2016/053947, filed on 15 Dec. 2016; which claims priority from GB Patent Application No. 1522135.1, filed 15 Dec. 2015, the entirety of both of which are incorporated herein by reference.

FIELD

The present invention relates to a pressure control device for use in oil and gas wells; in particular, the invention relates to a pressure control device for modulating pressure in a portion of a wellbore.

BACKGROUND

In the oil and gas exploration and extraction industries it is often desirable to be able to modulate downhole pressure when required. For example, it may be desirable to isolate a section of wellbore to create sections of differential pressure within the bore. A pressure control device may be used to create a seal within the bore, such that fluid pressure on one side of the seal increases relative to fluid pressure on the other side of the seal.

As wells get deeper, there is an increasing need to be able to transmit signals from surface to downhole locations which can be many miles away. Communication lines have to pass many restrictions including pressure control devices such as flexible cup seals. To bypass seals such as these, the conduit is separated and attached to either side of the seal to provide a continuous passage which maintains the integrity of the seal. However, with more sophisticated communication lines, such as a fibre-optic cable, the quality of information can be severely affected by splitting the cable in this way.

SUMMARY

According to a first aspect of the present invention there is provided a pressure control device for use in an oil well, the pressure control device comprising:

a support member configured to be located on a mandrel or a tubular, the support member defining at least one conduit throughbore configured to receive a conduit; and a flexible cup member mounted to the support member;

wherein, in use, a conduit can pass through the pressure control device intact.

In an embodiment of the present invention, a pressure control device is provided which can seal the annulus between a tubular and the casing and permit a well conduit, located in the annulus, to pass without the need to break the conduit, or pin the conduit against the tubular. This is of particular utility where the conduit is, for example, a fibre-optic cable, for relaying information from a downhole environment to the surface, as the integrity of the cable is paramount.

For the avoidance of doubt, by conduit it is meant an apparatus configured to carry information, signals, pressure, or any other form of communicating between a surface location and a downhole location. The conduit may be the communication conduit itself or a protective shell around the communication conduit.

The pressure control device may have a longitudinal axis.

In at least one embodiment, the longitudinal axis, in use, is aligned with a tubular or mandrel located in an oil well.

The support member may fully define the at least one conduit throughbore.

The/each support member conduit throughbore may comprise an at least one conduit seal configured, in use, to form a seal with the conduit.

The/each support member conduit throughbore may be configured to allow a single conduit to pass therethrough.

The support member may comprise a first section and a second section.

Each support member section may define a portion of the/each conduit throughbore.

Each support member section may define a longitudinal portion of the/each conduit throughbore.

The support member sections may be configured to be engaged, in use, to clamp, secure and/or seal the/each conduit in a conduit throughbore.

Each support member section may define an engaging surface, the support member first section engaging surface being complementary to the support member second section engaging surface, such that the respective engaging surfaces come into contact when the support member sections are engaged.

The support member section engaging surfaces may be adapted to form a seal therebetween.

The support member section engaging surfaces may define complementary interlocking surfaces.

The support member may comprise at least one support member seal adapted to form a seal between the support member sections.

At least a region of the support member first section engaging surface and at least a region of the support member second section engaging surface are arranged such that a pressure applied to an internal surface of the support member increases the seal between the support member sections.

The support member may be adapted to be mounted to a mandrel.

The support member may be adapted to be mounted to a mandrel such that rotational movement of the pressure control device with respect to the mandrel is prevented.

The flexible cup member may be configured to move between a run-in configuration and a deployed configuration.

In use, when used to form a seal with a tubular, the flexible cup member maximum diameter may be less than the tubular minimum internal diameter.

The flexible cup member may comprise a first section and a second section.

The flexible cup member first section may be associated with the support member first section and the flexible cup member second section may be associated with the support member second section.

Each flexible cup member section may define an engaging surface, the flexible cup member first section engaging surface being complementary to the second flexible cup member engaging surface, such that the respective engaging surfaces come into contact when the flexible cup member sections are engaged.

The flexible cup member section engaging surfaces may define complementary interlocking surfaces.

The flexible cup member section engaging surfaces may be adapted to form a contact seal therebetween.

At least a region of the flexible cup member first section engaging surface and at least a region of the second flexible cup member engaging surface are arranged such that a pressure applied to an internal surface of the flexible cup member increases the seal between the flexible cup member sections.

At least a region of the first flexible cup member section engaging surface may be defined by an internal surface of the first flexible cup member section and least a region of the second flexible cup member section engaging surface may be defined by an external surface of the second flexible cup member section.

The second flexible cup member section may be configured to extend around the majority of the circumference of the support member. In turn this would mean that the second flexible cup member section extends around the majority of the circumference of the mandrel or tubular to which the pressure control device is attached.

The flexible cup member may define an interface surface for engaging a support member interface surface, the support member interface surface defining a rib, the rib forming a contact seal with the flexible cup member interface surface.

The rib may be a circumferential rib.

According to a second aspect of the present invention there is provided a method of installing a pressure control device in an oil well:

attaching a pressure control device to a mandrel, the pressure control device having a support member and a flexible cup member, the flexible cup member being mounted to the support member, the support member defining at least one conduit throughbore configured to receive a conduit; and passing a conduit through a support member conduit throughbore.

According to a third aspect of the present invention there is provided a method of installing a pressure control device in an oil well:

attaching a pressure control device first portion to the mandrel, the pressure control device first portion comprising a support member first section and a flexible cup member first section;

laying a conduit in a conduit throughbore first section, the conduit throughbore first section defined by the support member first section;

attaching a pressure control device second portion to the mandrel, the pressure control device second portion comprising a support member second section and a flexible cup member second section, the support member second section defining a conduit throughbore second section; and connecting the pressure control device first portion to the pressure control device second section such that conduit throughbore first and second sections come together to form the conduit throughbore through the support member.

According to a fourth aspect of the present invention there is provided a pressure control device for use in an oil well, the pressure control device comprising:

a support member configured to be located on a mandrel or a tubular, the support member defining at least one conduit throughbore configured to receive a conduit; and a seal member mounted to the support member;

wherein, in use, a conduit can pass through the pressure control device intact.

The seal member may be a cup member.

The cup member may be flexible.

It will be understood that the features listed as non-essential features listed in respect of one aspect may be equally applicable to other aspects but have not been repeated for brevity.

BRIEF DESCRIPTION OF THE DRAWINGS

An embodiment of the present invention will now be described with reference to the accompanying drawings in which.

DETAILED DESCRIPTION OF THE DRAWINGS

Figure 1:
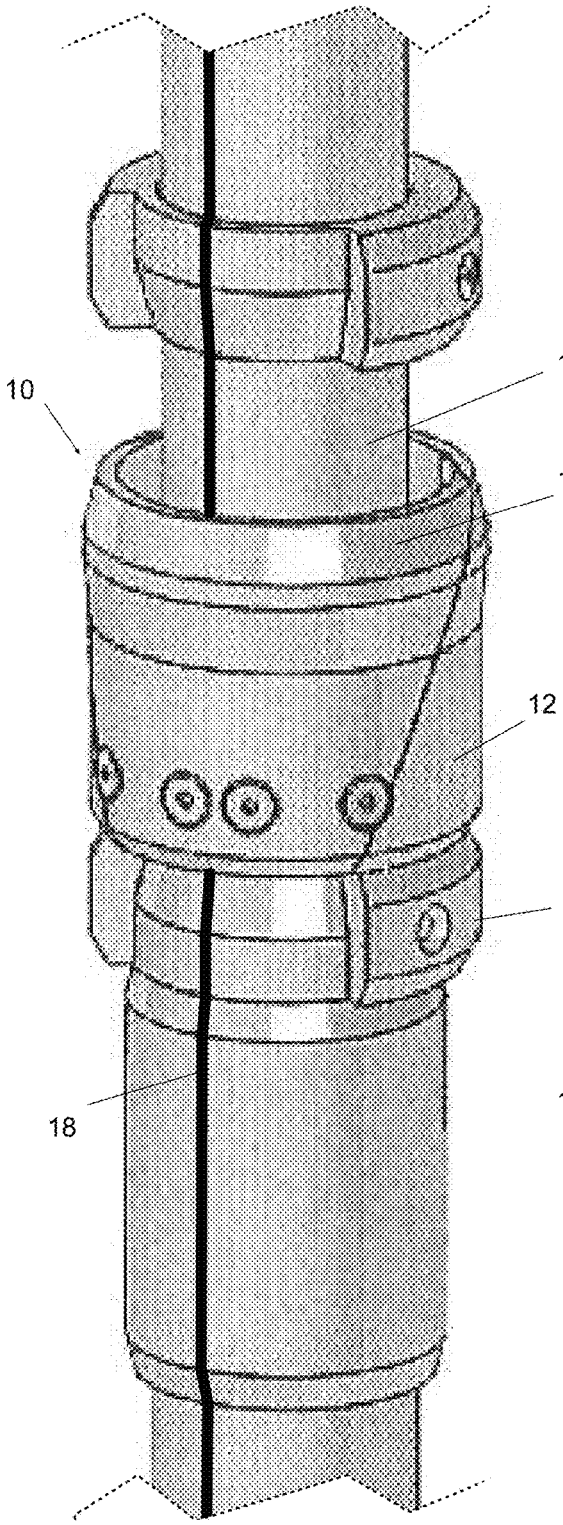
FIG. 1 is a perspective view of a pressure control device for use in an oil well shown fitted to a mandrel.
Figure 2:
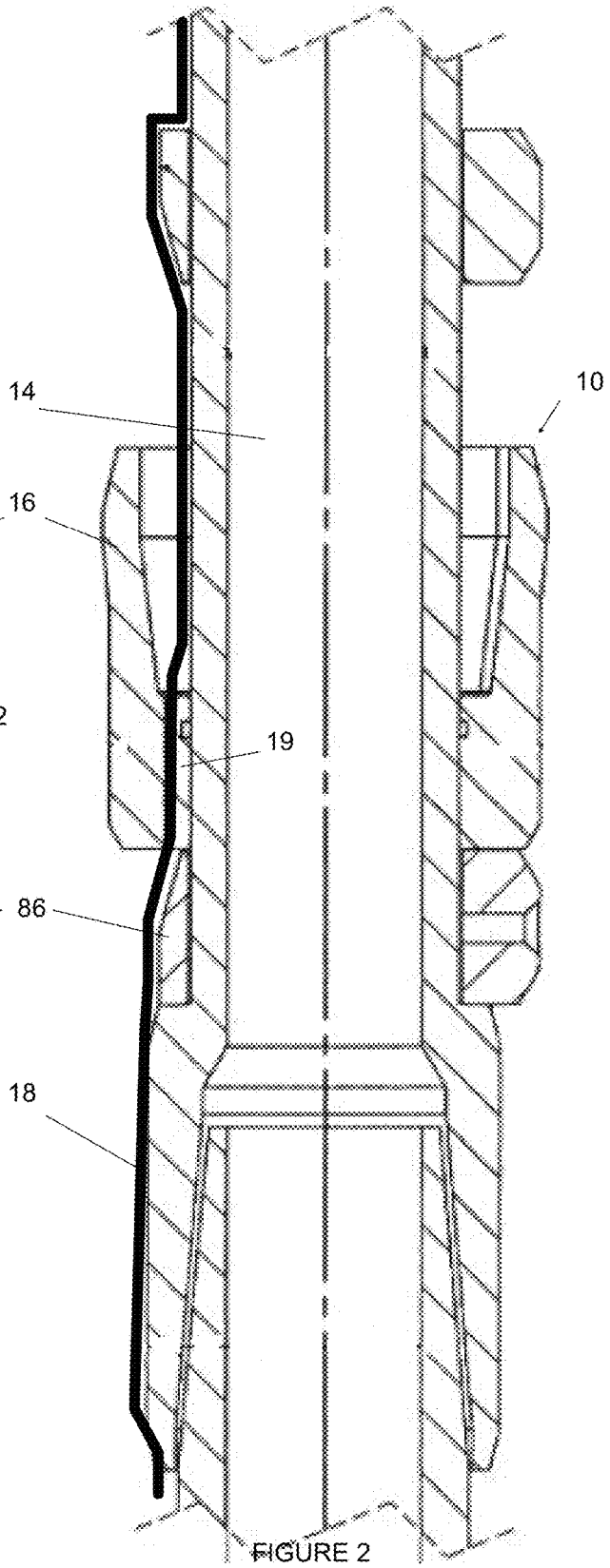
FIG. 2 is a section of the pressure control device 10 of FIG. 1.

Reference is first made to FIG. 1, a perspective view of a pressure control device, generally indicated by reference numeral 10, for use in an oil well (not shown) and FIG. 2, a section of the pressure control device 10 of FIG. 1, according to a first embodiment of the present invention.

The pressure control device 10 comprises a support member 12 located on a mandrel 14 and a flexible cup member 16 mounted to the support member 12.

Running up the side of the mandrel 14 from a downhole location to a surface location are five fibre-optic cables 18 of which one is shown for clarity. The cables 18 pass through the pressure control device 10, and particularly each cable 18 passes through a throughbore 19 in the support member 12, the throughbore 19 being one of five such throughbores 19 defined by the support member 12, as will be discussed in due course.

Such an arrangement permits the cables 18 to pass through the pressure control device 10 without the need for the fibre-optic cables 18 to be split.

Figure 3:
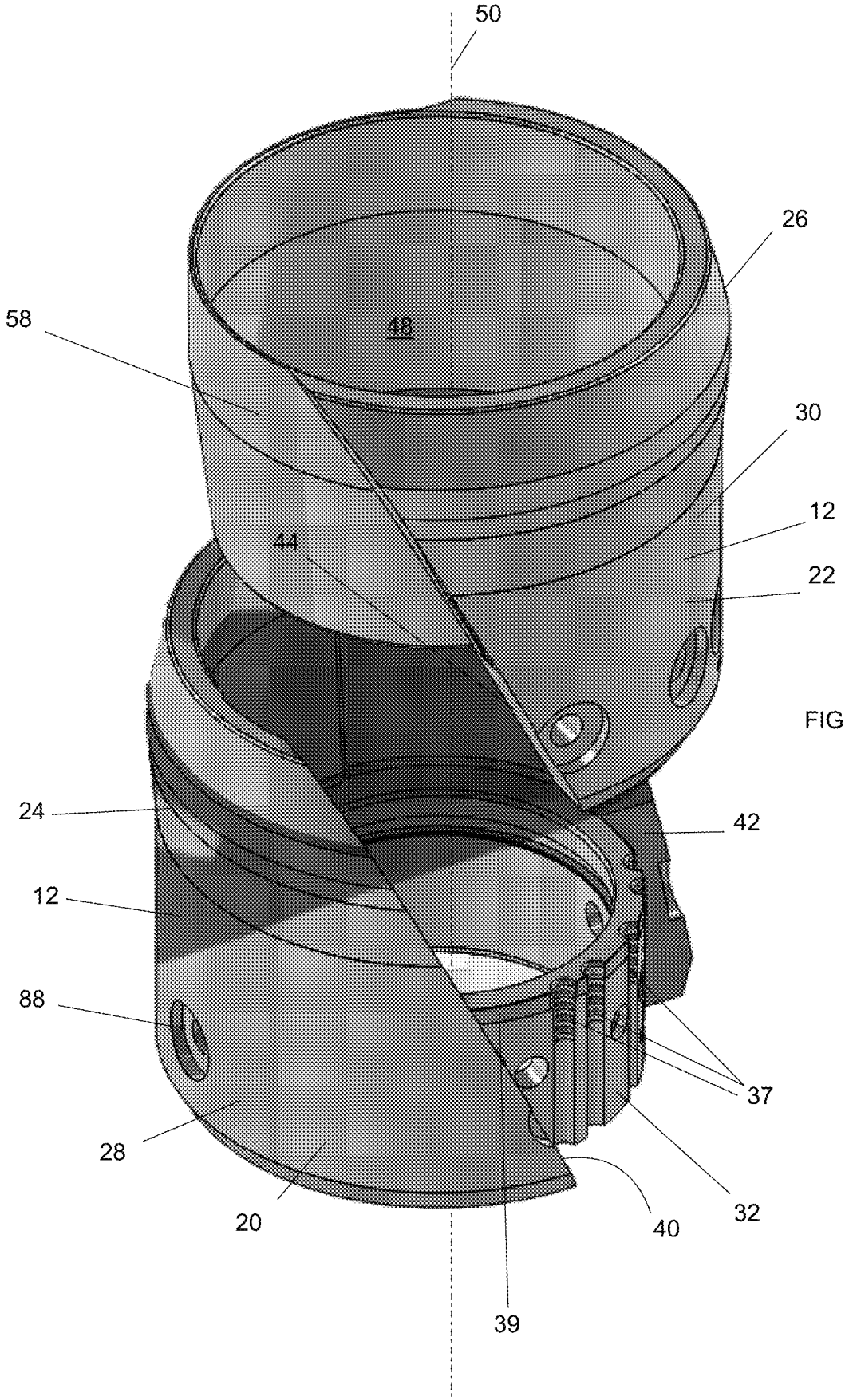
FIG. 3 is a perspective view of the pressure control device of FIG. 1 shown with the pressure control device sections separated.

Referring to FIG. 3, a perspective view of the pressure control device 10 of FIG. 1, it will be seen that the support member 12 comprises a support member first section 20 and a support member second section 22, and the flexible cup member 16 comprises a flexible cup member first section 24 and a flexible cup member second section 26.

The support member first section 20 and the flexible cup member first section 24 together form a pressure control device lower section 28, and the support member second section 22 and the flexible cup member second section 26 together form a pressure control device upper section 30.

The pressure control device lower and upper sections 28, 30 come together to form the pressure control device 10. Particularly, an engaging surface 32 defined by the support member first section 20 and an engaging surface 34 (not visible on FIG. 3) defined by the support member second section 22 are complementary and engage when the upper and lower sections 30, 28 are brought together.

The support member second section engaging surface 34 can be seen on FIG. 4, a perspective view, from below, of the pressure control device upper section 30. Looking at FIG. 4 and also FIG. 5, a perspective view from above of the support member first section 20, it can be seen that both of the support member sections 20, 22 define part of the five throughbores 19*a*-19*e*, such that engagement of the engaging surfaces 32, 34 create the fully defined throughbores 19.

Figure 5:
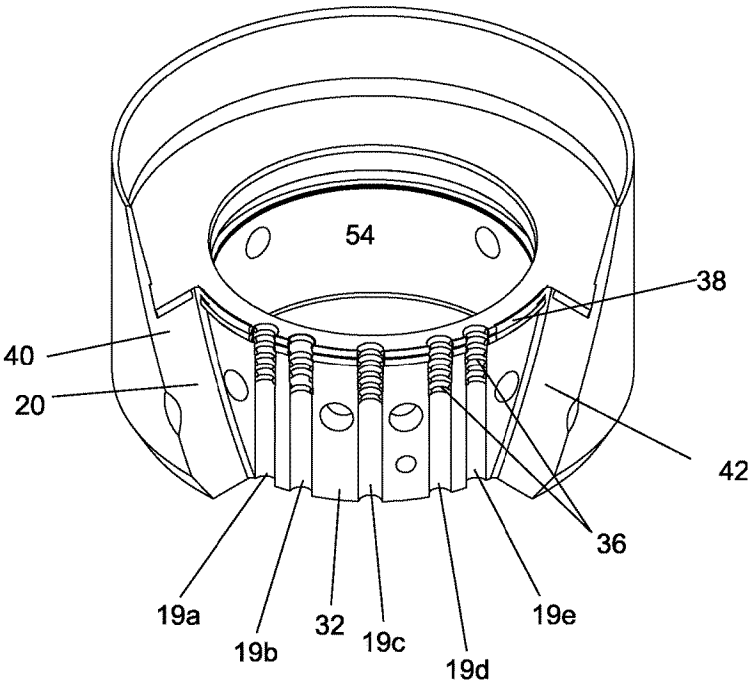
FIG. 5 is a perspective view, from above, of the support member first section.
Figure 4:
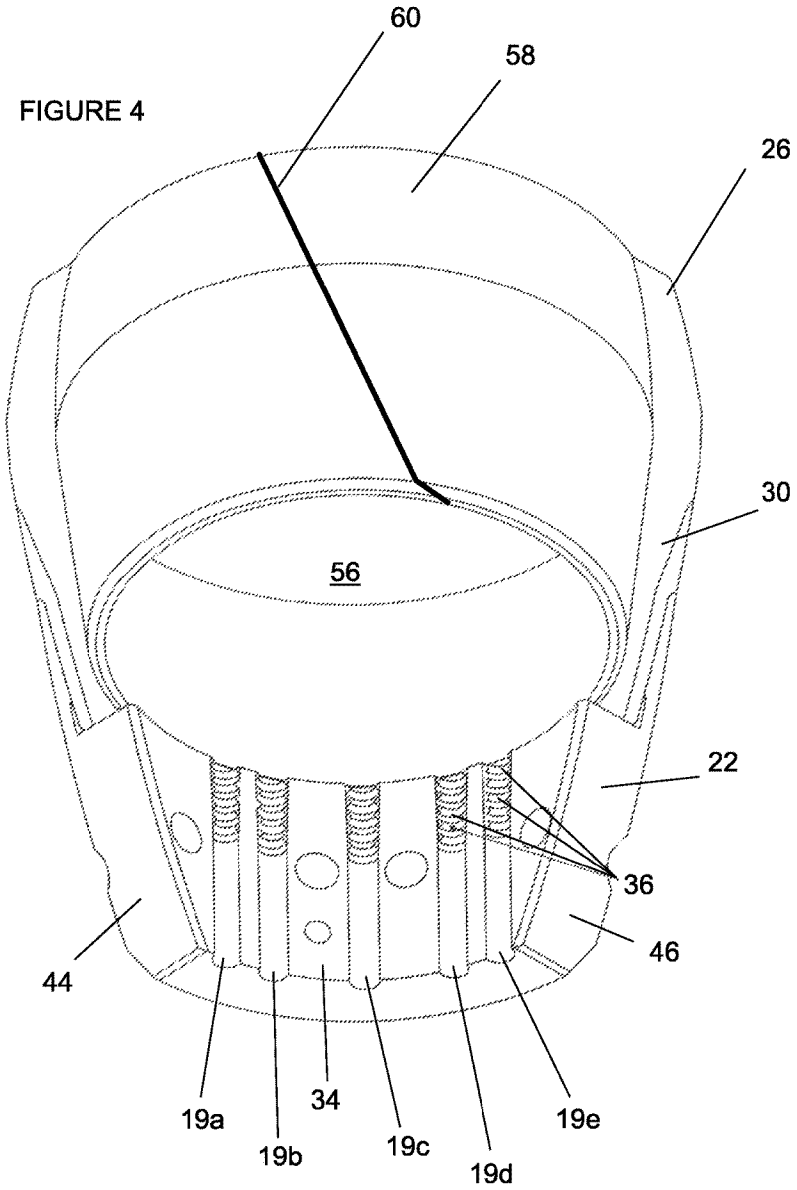
FIG. 4 is a perspective view, from below, of the pressure control device upper section.

As will also be noted from FIG. 4 and FIG. 5, the support member sections 20, 22 define a series of throughbore recesses 36 configured to receive a semicircular seal 37 (shown only on FIG. 3) to prevent leakage of pressure along the throughbores 19, depleting the effect of the pressure control device 10.

Again referring to FIG. 5, a further seal recess 38 extends along the support member first section engaging surface 32, the seal recess 38 being configured to receive a rubber seal 39 (shown only on FIG. 3).

The extreme edges of the support member first section engaging surface 32 are defined by support member faces 40, 42 which receive complementary support member faces 44, 46 defined by the support member second section when the pressure control device 10 is formed.

Figure 6:
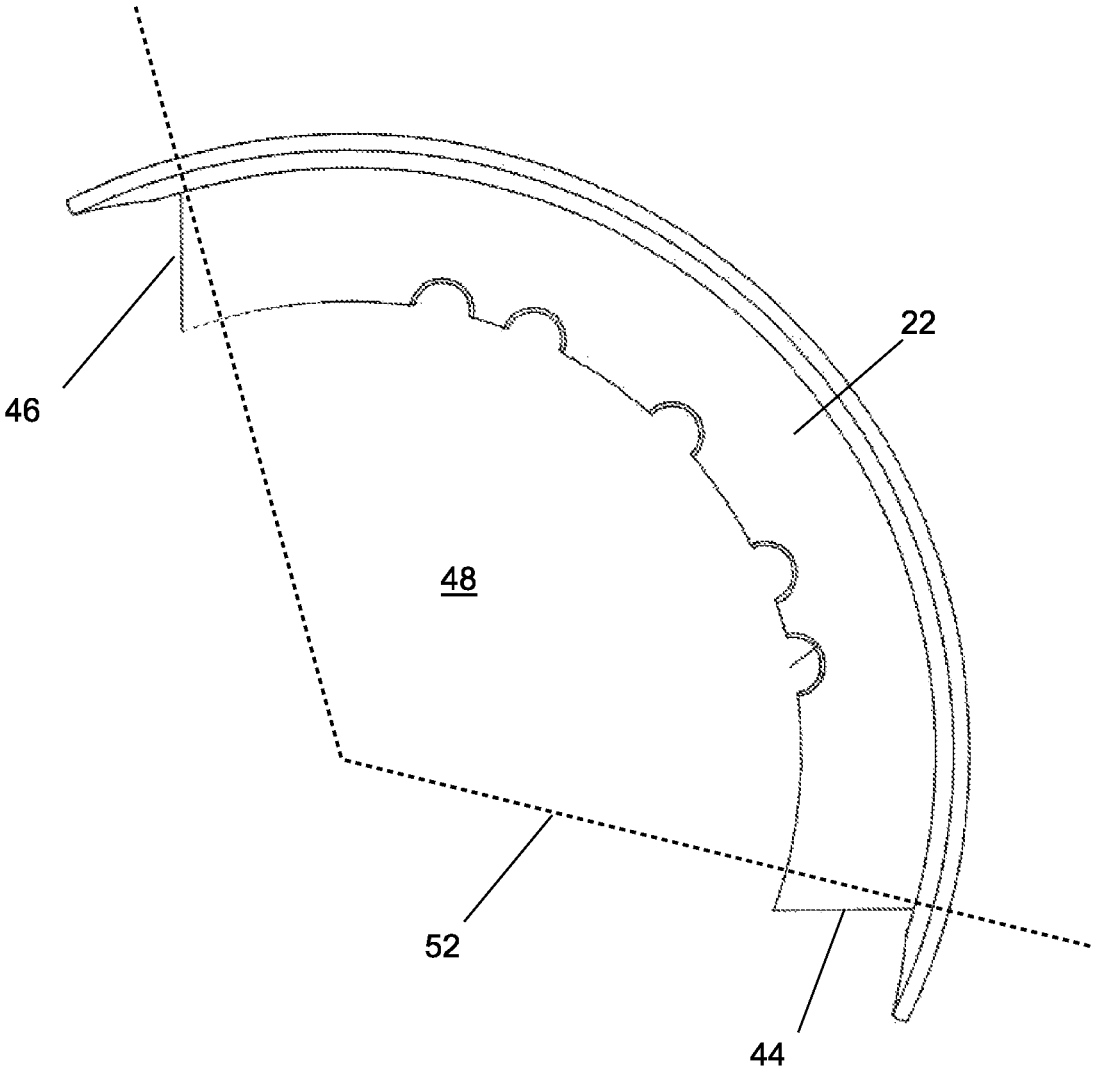
FIG. 6 is a plan view of the support member second section.

It will be noted from FIG. 3 that the support member faces 40, 42, 44, 46 are cut at an angle to the vertical axis 50 of the pressure control device 10; and, from FIG. 6, a plan view of the support member second section 22, is also cut at an angle to the radius 52 of the pressure control device 10. This arrangement ensures that, in use, pressure inside the flexible cup member 16 does not force the pressure control device support member sections 20, 22 apart. Indeed, the horizontal and vertical components of a force applied to a flexible cup member interior 48 would only act to increase the pressure on the interface between the support member faces 40, 42, 44, 46.

Referring to FIGS. 4 and 5, it will be noted from FIG. 5 that the support member first section 20 defines a throughbore 54 configured to receive the mandrel 14, and, from FIG. 4, the flexible cup member second section 26 includes an extending section 58 which defines a throughbore 56; the extending section being configured to wrap around the circumference of the mandrel 14.

The extending section 58 includes a cut 60 which, as will be shown in due course, permits the extending section 58 to be opened to allow the pressure control device upper section 30 to be fitted to the mandrel 14.

As is visible from FIG. 4, the extending section 60 is at an angle both to the vertical axis 50 (not shown on FIG. 4) of the pressure control device 10, and also at an angle to the radius 52 (not shown on FIG. 4) of the pressure control device 10.

Figure 7:
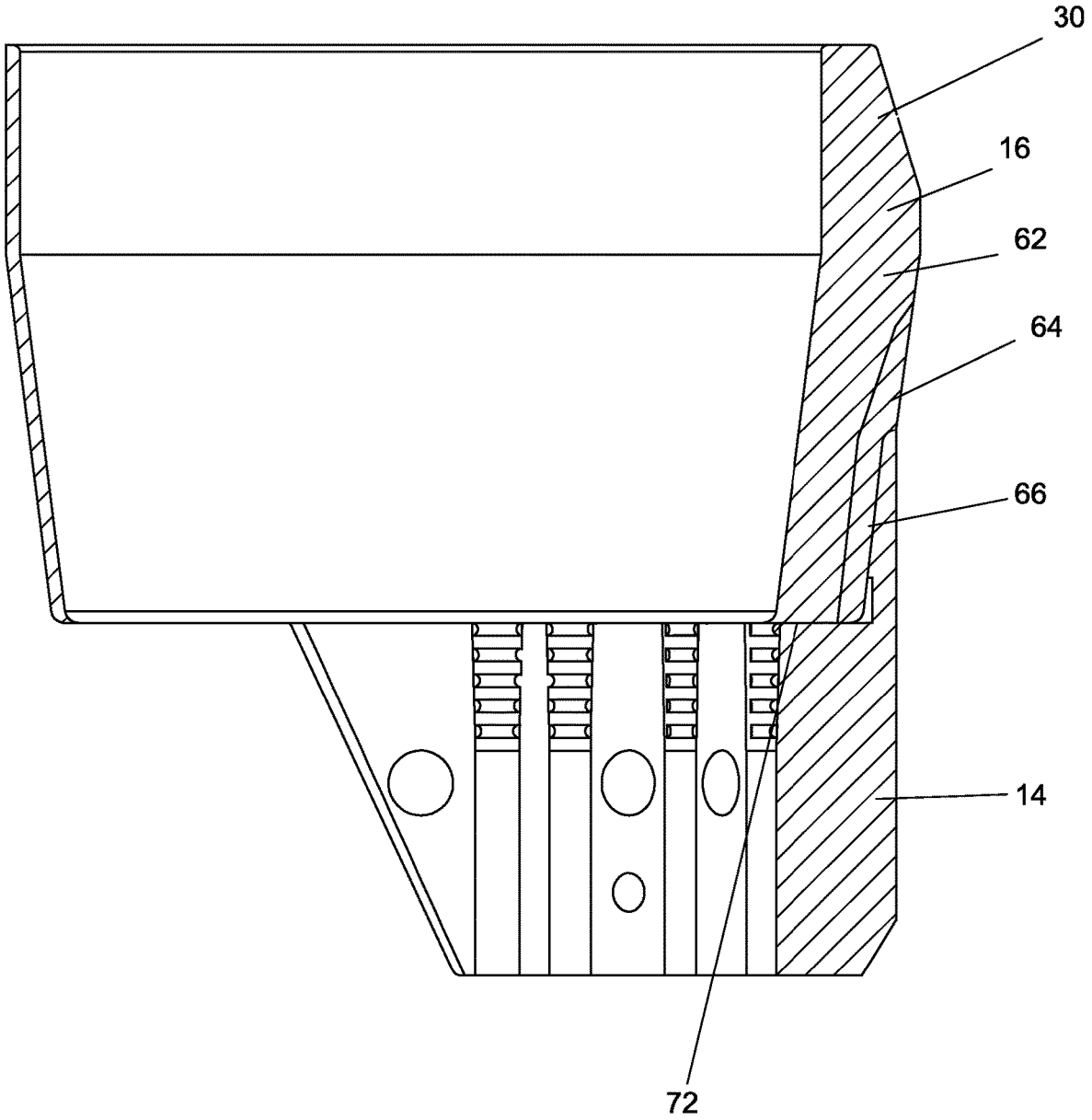
FIG. 7 is a section through the pressure control device upper section.
Figure 8:
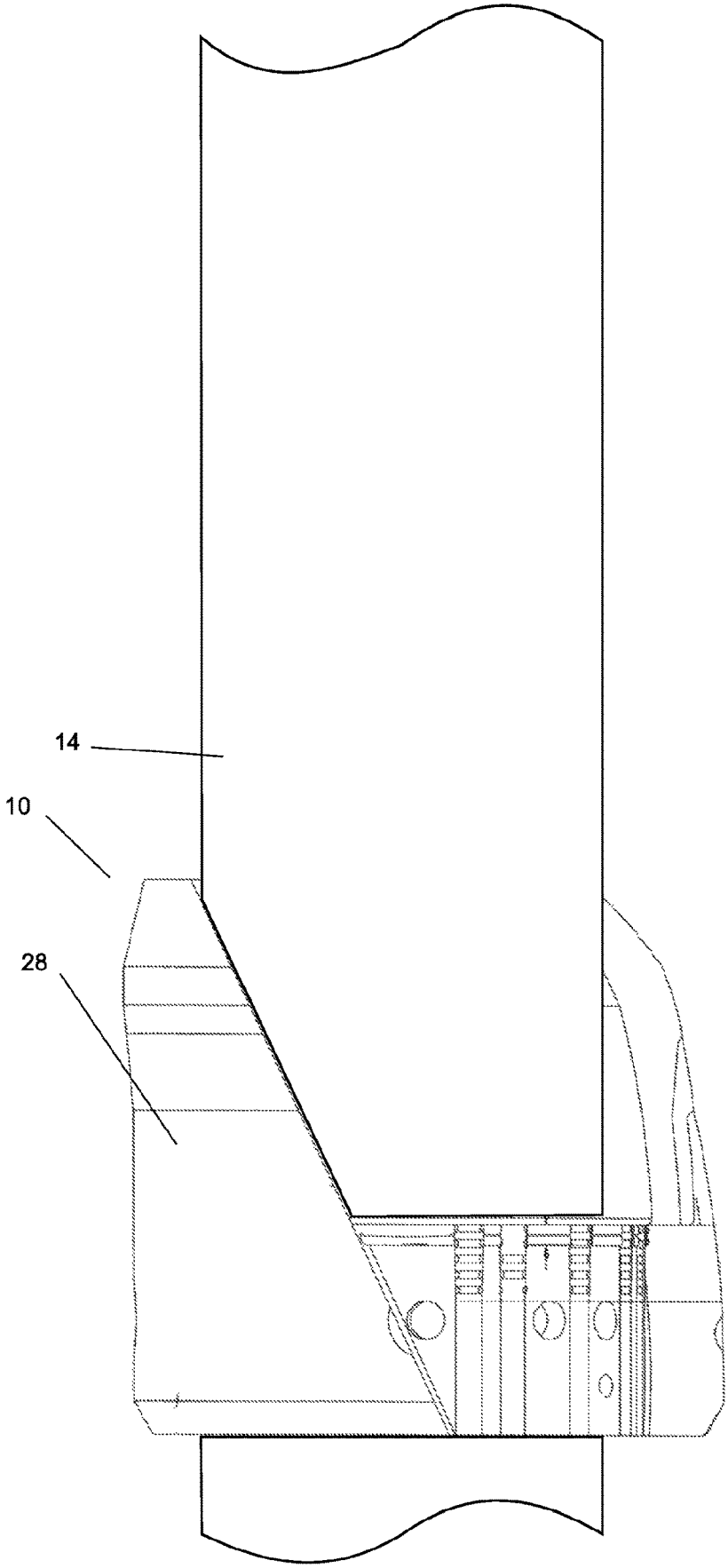
FIGS. 8 to 11 are a sequence of side views showing the installation of the pressure control device of FIG. 1.

Reference is now made to FIG. 7, a section through the pressure control device upper section 30. As can be seen, the flexible cup member 16 includes an elastomeric portion 62 and a mesh backup portion 64.

The flexible cup member 16 is bonded to the support member 12.

Installation of the pressure control device 10 will now be described with reference to FIGS. 8 to 11, a sequence of side views showing the installation of the pressure control device 10 of FIG. 1.

The pressure control device lower section 28 is slid down the mandrel 14 to the desired location. A collar 86 (shown in FIG. 1) may be installed to support the pressure control device lower section 28. Although not visible in FIG. 8, a threaded bore is provided on the pressure control device lower section 28 to allow the pressure control device lower section 28 to be secured to the mandrel 14. This threaded bore 88 can be seen on FIG. 3.

Figure 9:
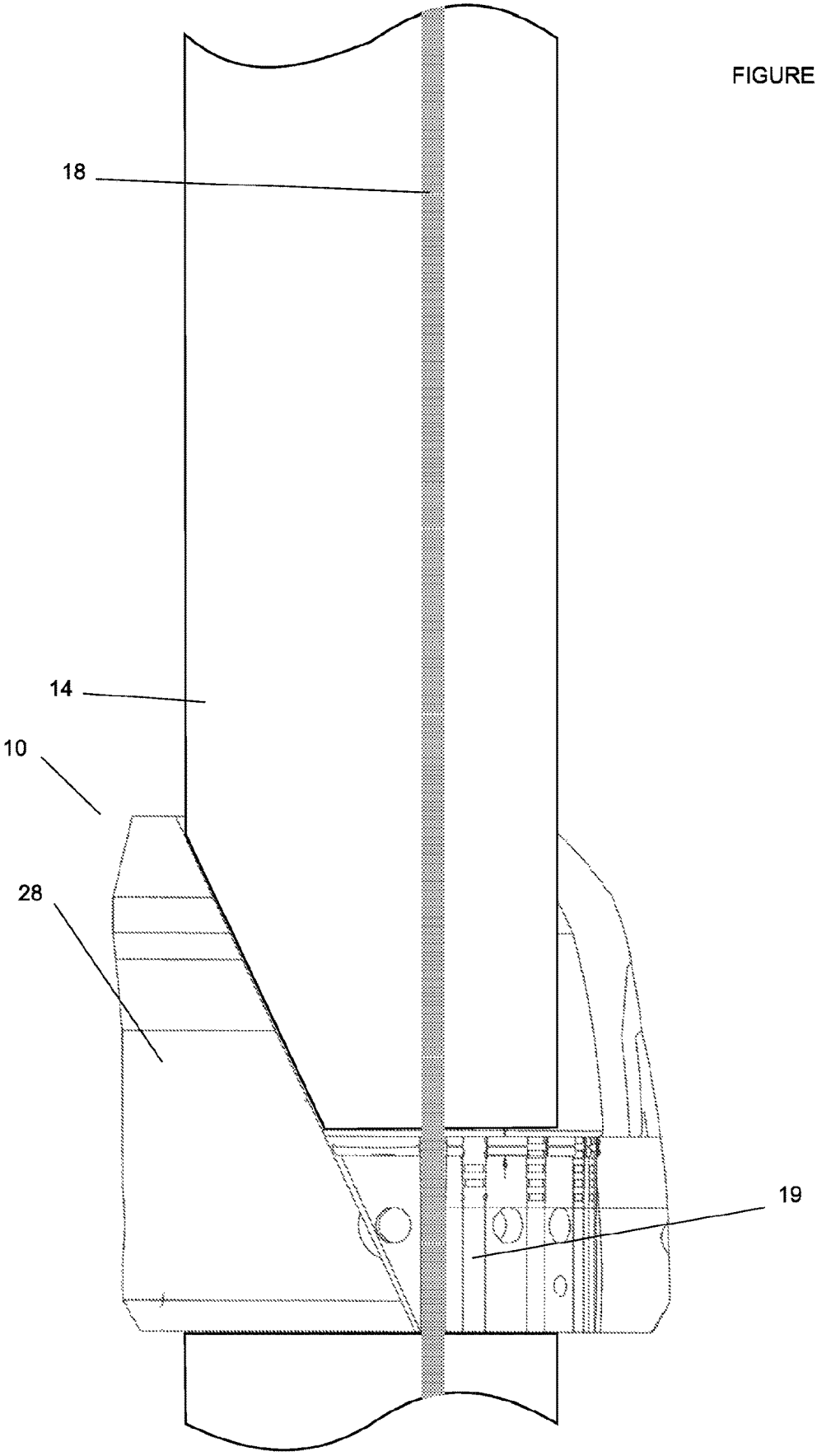

Referring to FIG. 9, the fibre-optic cables 18, of which one is shown, are positioned on the mandrel 14 and laid into the pressure control device throughbores 19.

Figure 10:
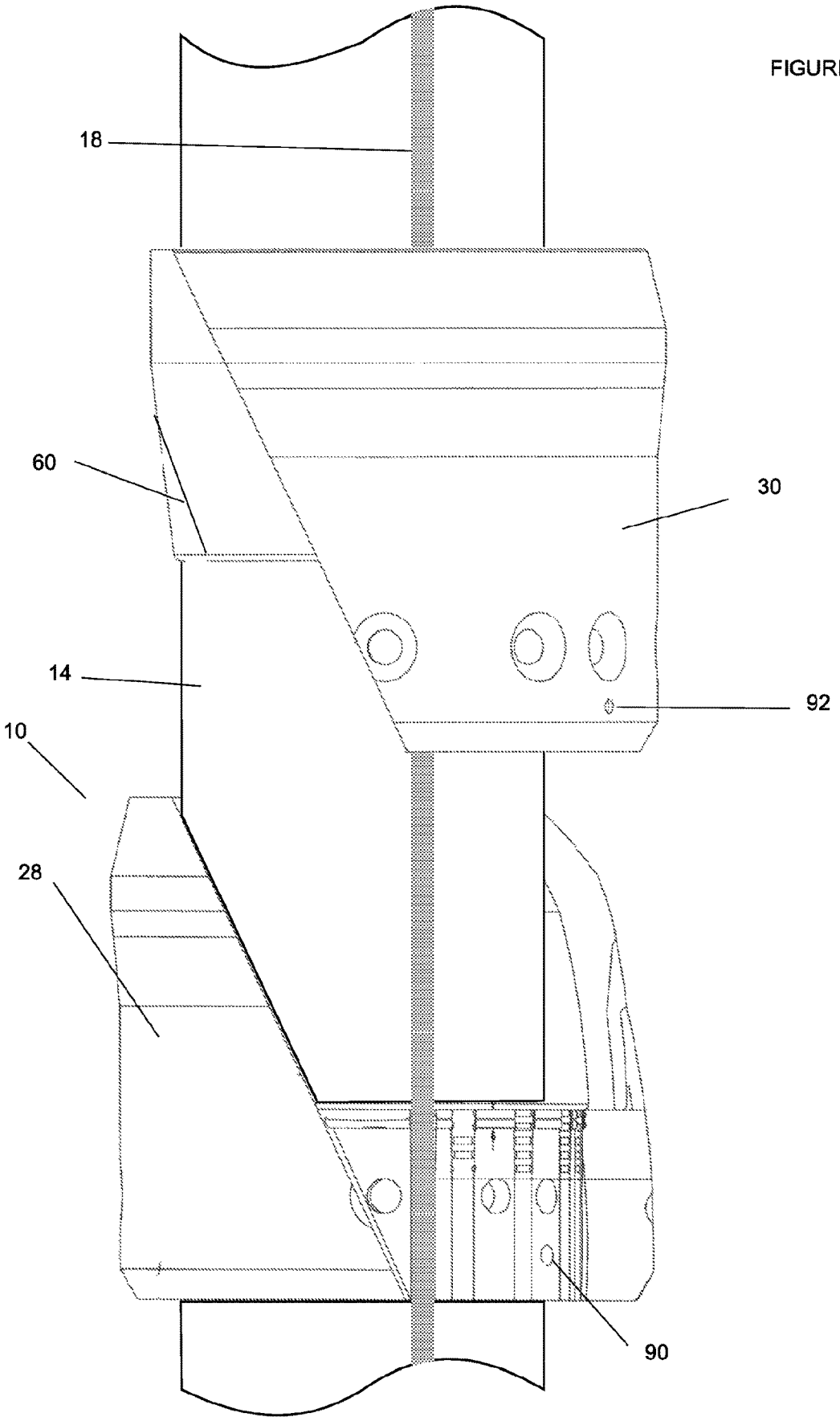

Referring to FIG. 10, the pressure control device upper section 30 is brought into engagement with the mandrel 14; the extending section cut 60 being opened up to allow the pressure control device upper section 30 to be fitted to the mandrel 14.

Figure 11:
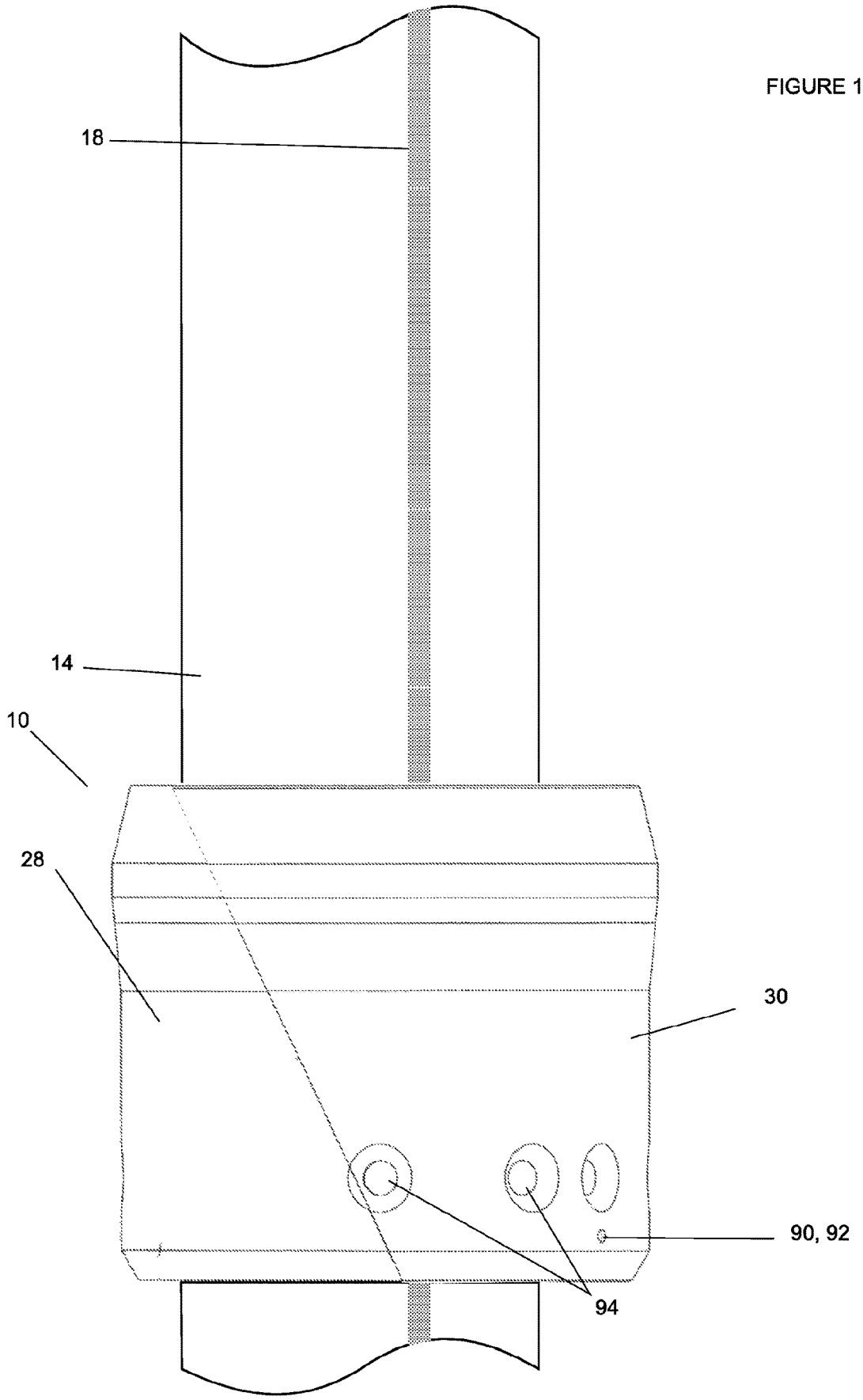

It will be noted that each of the pressure control device sections 28, 30 include an alignment hole 90, 92. These alignment holes 90, 92 are used to align the pressure control device sections 28, 30 when they are brought together as shown in FIG. 11.

Once brought into near alignment, a dowel (not shown) can be tapped into the alignment holes 90, 92, to complete alignment.

The pressure control device lower and upper sections 28, 30 are then bolted together and to the mandrel 14 through countersunk threaded bores 94 which secure the pressure control device to the mandrel. This completes the seal between the pressure control device sections 28, 30 and sealingly traps the fibre optic cables 18 within the pressure control device support member 12, such that the pressure control device 10 enables the fibre optic cables 18 to pass through the pressure control device 10 without severance, termination or damage in any form.

Various modifications and improvements may be made to the above-described embodiments without departing from the scope of the present invention. For example, although five conduit throughbores are shown, any suitable number may be utilised. In other embodiments, where less than five conduit throughbores are required, a plug may be provided to seal unused throughbores.

The invention claimed is:

1. A pressure control device for use in an oil well, the pressure control device comprising:

a support member configured to be located on a mandrel or a tubular, the support member comprising a first section and a second section, the support member defining at least one conduit throughbore configured to receive a conduit, each support member section defining a portion of the or each conduit throughbore, the support member comprising at least one support member seal adapted to form a seal between the support member sections; and a flexible cup member mounted to the support member; wherein, in use, a conduit can pass through the pressure control device intact.

2. The pressure control device of claim 1, wherein the support member fully defines the at least one conduit throughbore.

3. The pressure control device of claim 1, wherein the/each support member conduit throughbore comprises an at least one conduit seal configured, in use, to form a seal with the conduit.

4. The pressure control device of claim 1, wherein the/each support member conduit throughbore is configured to allow a single conduit to pass therethrough.

5. The pressure control device of claim 1, wherein each support member section defines a longitudinal portion of the/each conduit throughbore.

6. The pressure control device of claim 1, wherein the support member sections are configured to be engaged, in use, to at least one of clamp, secure and seal the or each conduit in a conduit throughbore.

7. The pressure control device of claim 1, wherein each support member section defines an engaging surface, the support member first section engaging surface being complementary to the support member second section engaging surface, such that the respective engaging surfaces come into contact when the support member sections are engaged.

8. The pressure control device of claim 7, wherein the support member section engaging surfaces define complementary interlocking surfaces.

9. The pressure control device of claim 7, wherein at least a region of the support member first section engaging surface and at least a region of the support member second section engaging surface are arranged such that a pressure applied to an internal surface of the support member increases the seal between the support member sections.

10. The pressure control device of claim 1, wherein the support member section engaging surfaces are adapted to form a seal therebetween.

11. The pressure control device of claim 1, wherein the support member is adapted to be mounted to a mandrel.

12. The pressure control device of claim 11, wherein the support member is adapted to be mounted to a mandrel such that rotational movement of the pressure control device with respect to the mandrel is prevented.

13. The pressure control device of claim 1, wherein in use, when used to form a seal with a tubular, the flexible cup member maximum diameter is less than the tubular minimum internal diameter.

14. The pressure control device of claim 1, wherein the flexible cup member comprises a first section and a second section.

15. The pressure control device of claim 1, wherein the flexible cup member comprises a first section and a second section, each flexible cup member section defining an engaging surface, the flexible cup member first section engaging surface being complementary to the second flexible cup member engaging surface, such that the respective engaging surfaces come into contact when the flexible cup member sections are engaged.

16. The pressure control device of claim 15, wherein the flexible cup member section engaging surfaces define complementary interlocking surfaces.

17. The pressure control device of claim 15, wherein the flexible cup member section engaging surfaces are adapted to form a contact seal therebetween.

18. The pressure control device of claim 15, wherein at least a region of the flexible cup member first section engaging surface and at least a region of the second flexible cup member engaging surface are arranged such that a pressure applied to an internal surface of the flexible cup member increases the seal between the flexible cup member sections.

19. The pressure control device of claim 15, wherein at least a region of the first flexible cup member section engaging surface is defined by an internal surface of the first flexible cup member section and least a region of the second flexible cup member section engaging surface is defined by an external surface of the second flexible cup member section.

20. The pressure control device of claim 15, wherein the second flexible cup member section is configured to extend around the majority of the circumference of the support member.

21. A method of installing a pressure control device in an oil well, comprising:

attaching a pressure control device first portion to a mandrel, the pressure control device first portion comprising a support member first section and a flexible cup member first section;

laying a conduit in a conduit throughbore first section, the conduit throughbore first section defined by the support member first section;

attaching a pressure control device second portion to the mandrel, the pressure control device second portion comprising a support member second section and a flexible cup member second section, the support member second section defining a conduit throughbore second section; and connecting the pressure control device first portion to the pressure control device second section such that conduit throughbore first and second sections come together to form the conduit throughbore through the support member;

wherein the support member comprises at least one support member seal adapted to form a seal between the support member sections when they come together.

* * * * *